United States Patent [19]

Abe

[11] Patent Number: 4,493,301

[45] Date of Patent: Jan. 15, 1985

[54] SYSTEM FOR REGULATING THE IDLE SPEED OF AN INTERNAL COMBUSTION ENGINE

[75] Inventor: Kunihiro Abe, Higashimurayama, Japan

[73] Assignee: Fuji Jukogyo Kabushiki Kaisha, Tokyo, Japan

[21] Appl. No.: 552,659

[22] Filed: Nov. 17, 1983

[30] Foreign Application Priority Data

Nov. 19, 1982 [JP] Japan ..... 57-204376

[51] Int. Cl.[3] ..... F02D 9/02; F02D 31/00

[52] U.S. Cl. ..... 123/339; 123/352

[58] Field of Search ..... 123/339, 352–355, 123/585; 180/176, 179

[56] References Cited

U.S. PATENT DOCUMENTS

| | | | |
|---|---|---|---|
| 4,402,288 | 9/1983 | Ohgami et al. | 123/339 |
| 4,425,888 | 1/1984 | Engel et al. | 123/339 |
| 4,428,341 | 1/1984 | Hassler et al. | 123/339 X |
| 4,432,317 | 2/1984 | Kawamura | 123/339 |

FOREIGN PATENT DOCUMENTS

| | | | |
|---|---|---|---|
| 110743 | 7/1982 | Japan | 123/339 |

*Primary Examiner*—Tony M. Argenbright

*Attorney, Agent, or Firm*—Martin A. Farber

[57] ABSTRACT

A system for regulating the idle speed of an internal combustion engine with an electronic fuel injection system having a bypass around a throttle valve of the engine and a solenoid operated control valve provided in the bypass to control the volume of air flow passing the bypass. The system comprises an engine speed sensor for sensing the engine speed of the engine and for producing an engine speed voltage, an idle switch responsive to idle operation of the engine for producing an idle signal, and a reference voltage circuit for producing a reference voltage corresponding to a predetermined idle speed. A first integrator is provided for integrating the difference between the engine speed voltage and the reference voltage and for producing a voltage. A control signal generating circuit is provided to be responsive to the voltage of the integrator for producing a positive going control signal and negative going control signal at upper limit and lower limit of the integrator output voltage. A second integrator is responsive to the positive going and negative going control signals to produce a control voltage. The control voltage is applied to a driver for energizing the solenoid of the solenoid operated control valve to actuate the control valve to regulate the idle speed to the predetermined idle speed.

2 Claims, 3 Drawing Figures

SYSTEM FOR REGULATING THE IDLE SPEED OF AN INTERNAL COMBUSTION ENGINE

BACKGROUND OF THE INVENTION

The present invention relates to a system for regulating the idle speed of an internal combustion engine with an electronic fuel injection system, and more particularly to a system for adjusting the volume of intake air passing through a bypass around a throttle valve so as to keep the idle speed to a predetermined speed.

Generally, the volume of intake air is measured by an air flow meter provided in an intake passage to convert to an electric air flow signal which is fed to an electronic control unit. The electronic control unit is provided with a feedback control circuit responsive to the air flow signal for producing a control signal. The control signal is applied to a solenoid for a regulator valve provided in the bypass to regulate the idle speed.

In a conventional feedback control circuit includes an engine speed sensor, an integrator for comparing the engine speed sensed by the engine speed sensor with a reference value and for producing an output, and a driver responsive to the output of the integrator to energize the solenoid of the regulator valve so as to regulate the idle speed to a predetermined speed.

On the other hand, the idle speed in one revolution of the crankshaft of the engine fluctuates by influences of operations such as compression, expansion and others. If such a fluctuation of idle speed is sensed by the engine speed sensor and idle speed is regulated, the engine speed is vainly regulated in accordance with the fluctuation and hunting of the system will occur.

SUMMARY OF THE INVENTION

The object of the present invention is to provide a system for regulating idle speed which is not responsive to small fluctuations of idle speed and has a high response.

According to the present invention, there is provided a system for regulating the idle speed of an internal combustion engine with an electronic fuel injection system having a bypass around a throttle valve of the engine and a solenoid operated control valve provided in the bypass to control the volume of air flow passing the bypass, comprising: means for sensing the engine speed of said engine and for producing an engine speed voltage; an idle switch responsive to the idle operation of said engine for producing an idle signal; a reference voltage circuit for producing a reference voltage corresponding to a predetermined idle speed; a first integrating circuit comprising an integrator for integrating the difference between said engine speed voltage and said reference voltage and for producing an output, and first switch means for causing said output to go to zero; a control signal generating circuit comprising first and second comparators which are responsive said output of said first integrating circuit for producing switch actuating signals when said output reaches predetermined upper limit voltage and lower limit voltage respectively, second and third switches means responsive to said switch actuating signals for producing a positive going control signal and a negative going control signal, and gate means responsive to said switch actuating signals for operating said first switch means; a second integrating circuit responsive to said positive and negative going control signals for producing a control voltage; and a driver responsive to said control voltage for energizing a solenoid of said solenoid operated control valve to actuate said control valve to regulate the idle speed to the predetermined idle speed.

The other objects and features of this invention will be apparently understood from the following description with reference to the accompanying drawings hereinafter.

DETAILED DESCRIPTION OF THE PREFERRED EMBODIMENT

Figure 1:
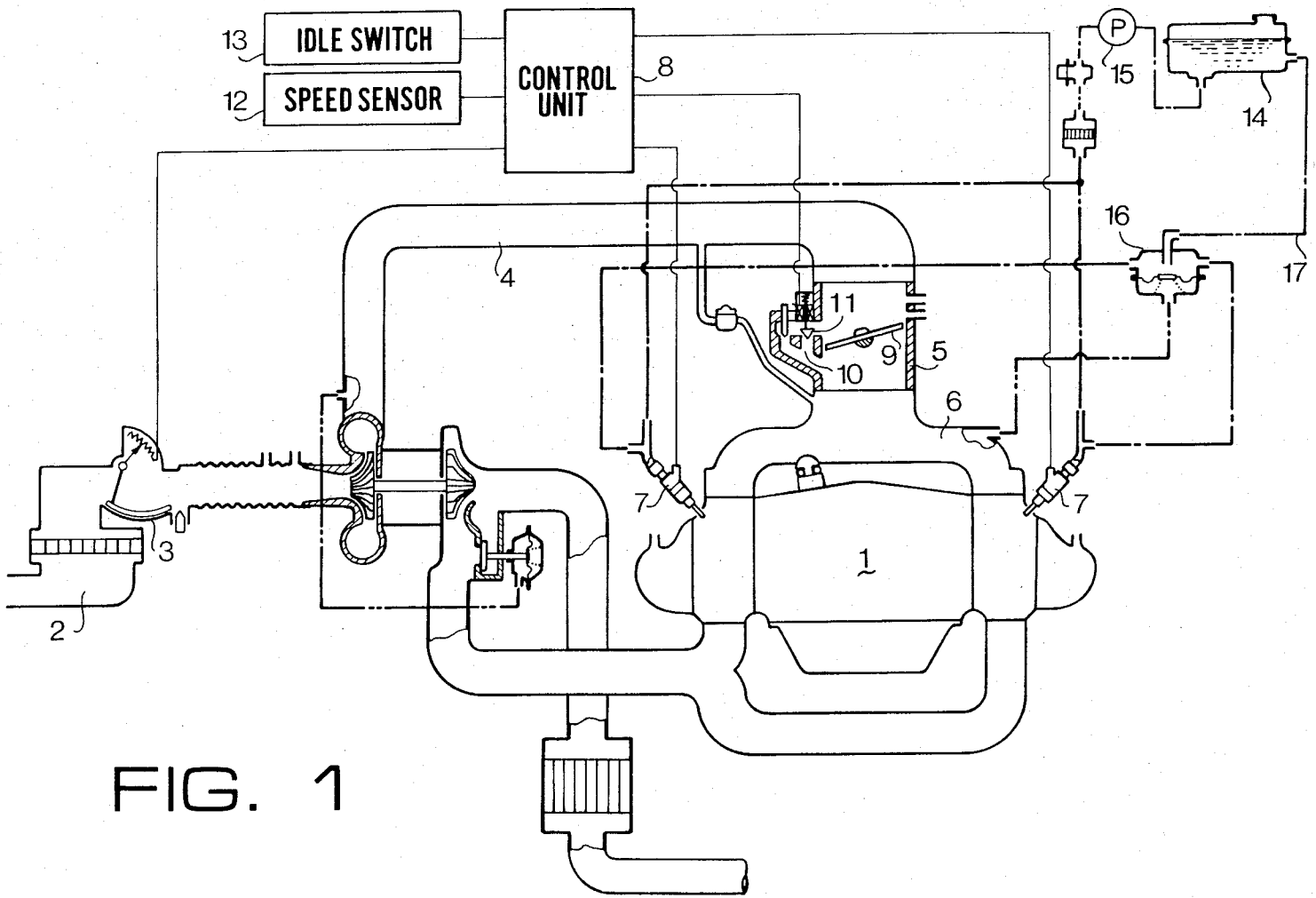
FIG. 1 is a schematic view showing an embodiment of the present invention.

Referring to FIG. 1, an engine 1 is an opposed-four-cylinder type engine and provided with an intake pipe 4 and air flow meter 3 at downstream of an air cleaner 2, a throttle body 5 communicated with the intake pipe 4, and with an intake manifold 6. A fuel injection valve 7 is provided on a branch of each intake manifold. Each fuel injection valve 7 supplies fuel to the corresponding cylinder from a fuel tank 14 by a fuel pump 15 and surplus fuel returns to the fuel tank 14 through a pressure regulator 16 and conduit 17. Opening and closing of the fuel injection valve 7 is controlled by a control signal from an electronic control unit 8. The control unit 8 is applied with signals from airflow meter 3, a coolant temperature sensor (not shown) and others in order to control the fuel injection.

A bypass 10 is provided around a throttle valve 9 in the throttle body 5. A control valve 11 is provided in the bypass 10 to control the volume of air flow passing through there. The electronic control unit 8 is applied with an idle signal from an idle switch 13 when idling and with an engine speed signal from an engine speed sensor 12 thereby to operate the control valve 11.

Figure 2:
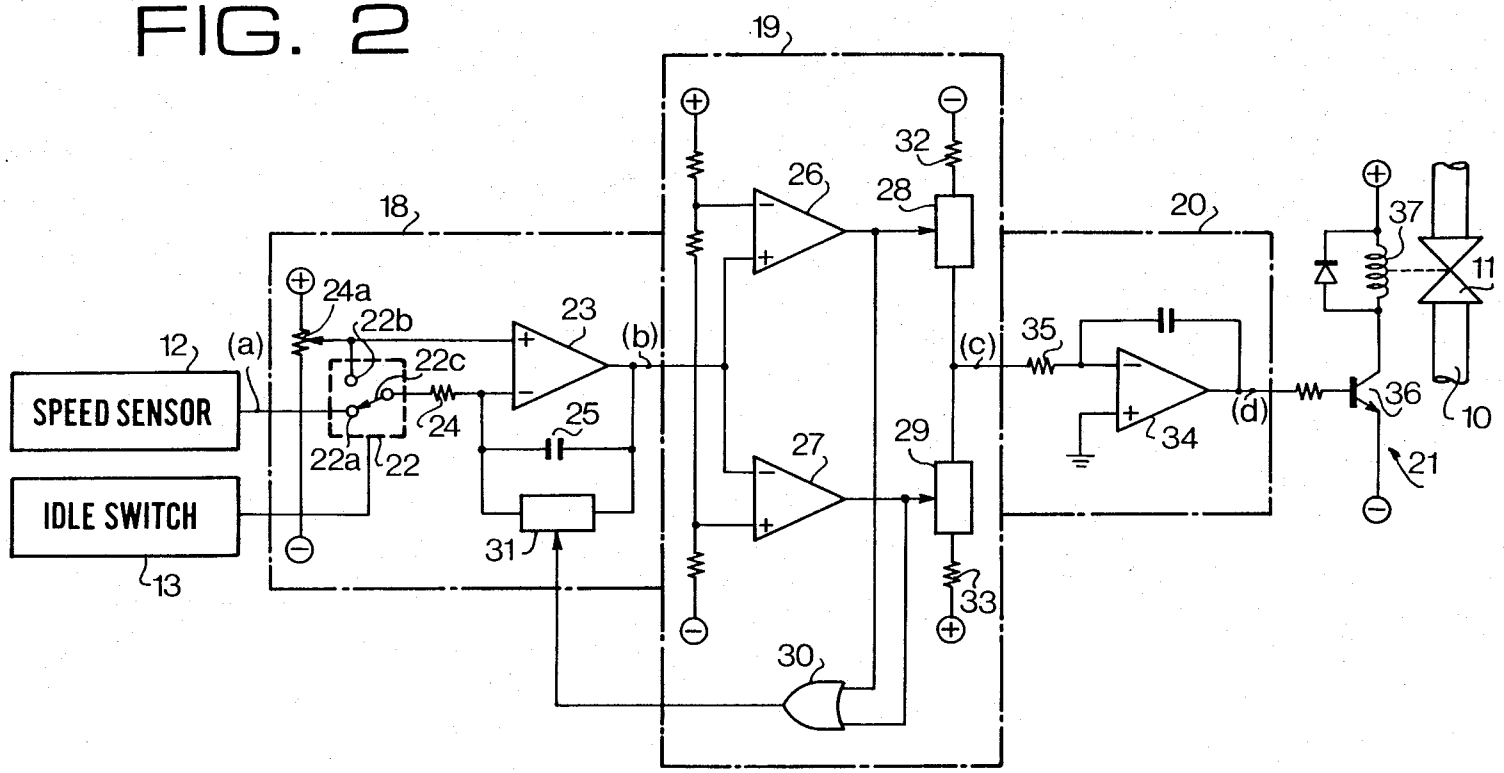
FIG. 2 is a feedback control circuit according to the present invention.

Referring to FIG. 2, the control unit comprises a first integrating circuit 18, control signal generating circuit 19, second integrating circuit 20, and driver 21. The engine speed sensor 12 is responsive to ignition pulses to produce an engine speed signal, and the idle switch 13 is operated by an accelerator pedal of a vehicle to produce an idle signal at the idling position of the accelerator pedal, where the throttle valve 9 is closed. The output of the idle switch 13 is connected to a control gate of a changeover switch 22 of first integrating circuit 18 to change connections between contacts **22*a* and 22*b*. The output of the engine speed sensor 12 is connected to the contact 22*a*. A movable contact 22*c* of the changeover switch 22 is connected to an inverting input of an integrator 23 comprising an operational amplifier with a resistor 24 and a capacitor 25. In order to give a reference idle speed voltage, a variable resistor 24*a* is provided, a slider of which is electrically connected to the contact 22*b* and to the noninverting input of the integrator 23. The output of the integrator 23 is connected to a noninverting input of a first comparator and to an inverting input of a second comparator 27. The comparator 26 is adapted to produce a switch actuating signal, when positive going output of the integrator 23 reaches a predetermined upper limit value. On the other hand the second comparator 27 is adapted to produce a switch actuating signal, when negative going output of the integrator 23 reaches a predetermined lower limit value. The output of the comparator 26 is connected to a control gate of a negative voltage applying switch 28 and the output of the comparator 27 is connected to a control gate of a positive voltage applying switch 29. Further, both output of comparators 26 and 27 are connected to inputs of an OR gate 30. The output of the OR gate 30 is connected to a control gate of a switch 31 parallely connected to the capacitor 25**.

An end of the switch 28 is connected to a negative source through a resistor 32 and an end of the switch 29 is connected to a positive source through a resistor 33. Other ends of both switches 28 and 29 are connected to an inverting input of an integrator 34 of the second integrating circuit 20 through a resistor 35. The output of the integrator 34 is connected to a base of a transistor 36 of the driver 21. The transistor 36 is provided in a circuit of a solenoid 37 for actuating the control valve 11.

In operation, in idling conditions, the output of the idle switch 13 causes the movable contact **22*c* to connect with the contact 22*a*, so that the output of the engine speed sensor 12 is applied to the integrator 23. When the engine idle speed is equal to a predetermined idle speed, the voltage at the inverting input of the integrator 23 is equal to that of the noninverting input. Accordingly, the outputs of integrator 23 is zero and hence the transistor 36 is off, so that the control valve 11** is in closed state.

Figure 3:
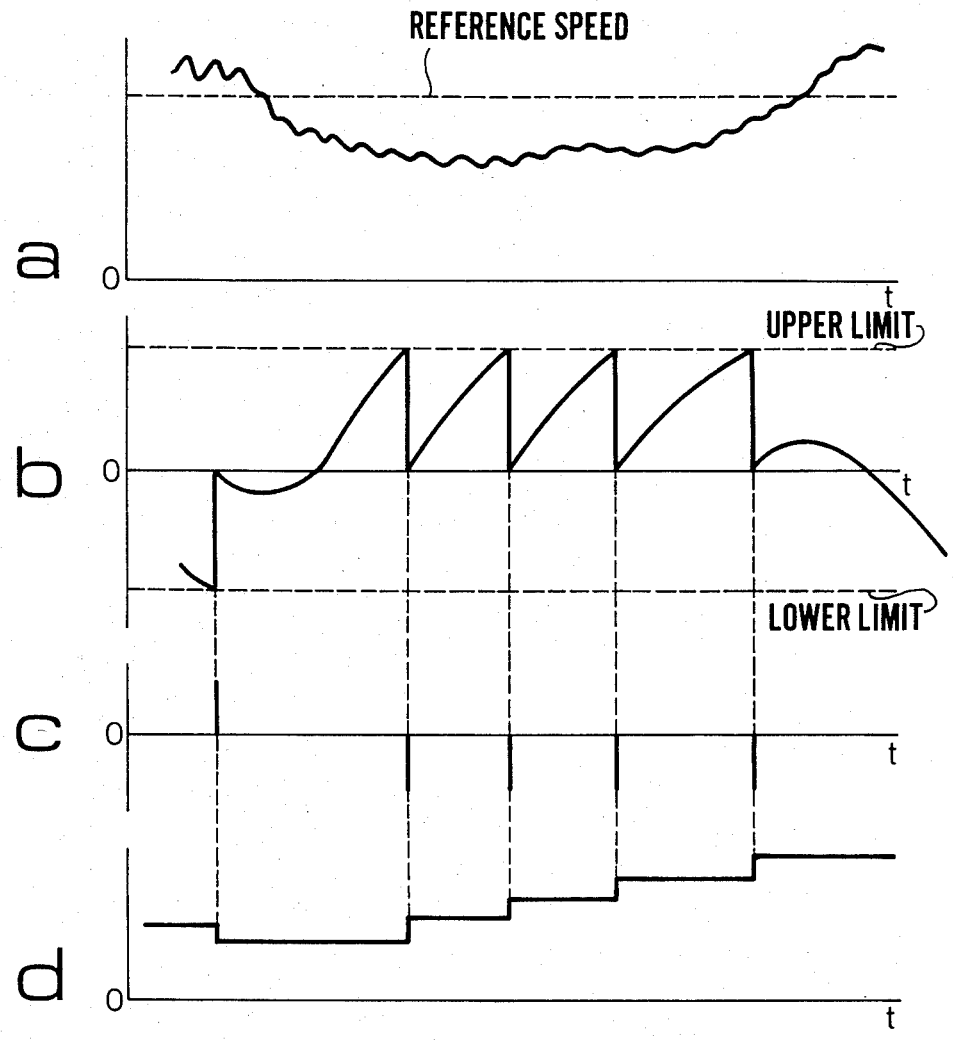
FIG. 3 shows waveforms at various portions of the circuit of FIG. 2.

When idle speed decreases because of increase of electric load such as head lights, the voltage at the inverting input of integrator 23 drops. Accordingly, the output voltage of the integrator 23 progressively rises by integrating operation as shown in FIG. 3(*b*). When the output voltage exceeds the predetermined upper limit value, the comparator 26 produces the switch actuating signal which causes the switches 28 and 31 to close. Thus, a negative voltage (FIG. 3(*c*)) is applied to the integrator 34 and the output of the integrator 23 goes to zero. On the other hand, the integrator 34 produces an output (FIG. 3(*d*)) in response to the output of FIG. 3(*c*), so that the transistor 36 becomes conductive in dependence of the output(d). Thus, the solenoid 37 is energized to open the control valve 11 so as to increase the volume of air flow passing through the bypass 10. As a result, the output of the air flow meter 3 increases, so that the control signal of electric control unit 8 varies to increase the amount of fuel injected from injection valves 7. Thus, engine idle speed is increased. Such an operation repeats as long as the idle speed is lower than the set value. The magnitude of the opening area of the value 11 increases with the increase of the output (d). When the idle speed rises to the predetermined engine speed, the transistor 36 is turned off to close the control valve 11.

As shown in FIG. 3, fluctuations of idle speed (FIG. 3(*a*)) are averaged by the integrator 23, so that small fluctuations disappear in the waveform of FIG. 3(*b*). Thus, the control operation is not influenced by the fluctuations.

When the idle speed is higher than the predetermined idle speed, the integrator 23 produces a negative output voltage. When the negative output voltage reaches the predetermined lower limit value, the comparator 27 produces a switch actuating signal, which causes switches 29 and 31 to close. Thus, the integrator 34 produces a negative voltage which renders the transistor 36 nonconductive, thereby to close the control valve 11. Therefore, the idle speed decreases to the set speed.

When the accelerator pedal is depressed, the output of idle switch 13 changes to a low level thereby to change the contact of the movable contact **22*c* to the contact 22*b*. Thus, the output of the integrator 23 becomes a low level, so that the transistor 36 becomes nonconductive to close the control valve 11**.

From the foregoing it will be understood that the present invention provides a system for regulating idle speed which is not influenced by small fluctuations of idle speed, so that rapid response can be obtained and hunting of the system can be prevented.

While the presently referred embodiment of the present invention has been shown and described, it is to be understood that this disclosure is for the purpose of illustration and that various charges and modifications may be made without departing from the spirit and scope of the invention as set forth in the appended claim.

What is claimed is:

1. A system for regulating the idle speed of an internal combustion engine with an electronic fuel injection system having a bypass around a throttle valve of the engine and a solenoid operated control valve provided in the bypass to control the volume of air flow passing the bypass, comprising:

means for sensing the engine speed of said engine and for producing an engine speed voltage;

an idle switch responsive to the idle operation of said engine for producing an idle signal;

a reference voltage circuit for producing a reference voltage corresponding to a predetermined idle speed;

a first integrating circuit comprising an integrator for integrating the difference between said engine speed voltage and said reference voltage and for producing an output, and first switch means for causing said output to go to zero;

a control signal generating circuit comprising first and second comparators which are responsive said output of said first integrating circuit for producing switch actuating signals when said output reaches predetermined upper limit voltage and lower limit voltage repectively, second and third switch means reponsive to said switch actuating signals for producing a positive going control signal and a negative going control signal, and gate means responsive to said switch actuating signals for operating said first switch means;

a second integrating circuit responsive to said positive and negative going control signals for producing a control voltage; and a driver responsive to said control voltage for energizing a solenoid of said solenoid operated control valve to actuate said control valve to regulate the idle speed to the predetermined idle speed.

2. The system for regulating the idle speed according to claim 1 wherein each of said integrators is formed by an operational amplifier and said driver comprises a transistor.

* * * * *